US007349646B2

(12) United States Patent
Choi et al.

(10) Patent No.: US 7,349,646 B2
(45) Date of Patent: Mar. 25, 2008

(54) TONER CARTRIDGE USED WITH AN ELECTROPHOTOGRAPHIC IMAGE FORMING APPARATUS

(75) Inventors: Sam-seok Choi, Suwon-si (KR); Myoung-su Baek, Suwon-si (KR); Dong-hoon Park, Osan-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/917,487

(22) Filed: Aug. 13, 2004

(65) Prior Publication Data

US 2005/0084283 A1 Apr. 21, 2005

(30) Foreign Application Priority Data

Oct. 20, 2003 (KR) ..... 10-2003-0072987

(51) Int. Cl.
*G03G 15/08* (2006.01)

(52) U.S. Cl. ..... 399/103; 399/119; 399/265

(58) Field of Classification Search ..... 399/103
See application file for complete search history.

(56) References Cited

U.S. PATENT DOCUMENTS 5,170,213 A * 12/1992 Yamaguchi et al. ..... 399/281
5,701,563 A * 12/1997 Fukuda et al. ..... 399/284
2002/0012551 A1* 1/2002 Tsutsui et al. ..... 399/281
2003/0231906 A1* 12/2003 Yoshizawa ..... 399/281

FOREIGN PATENT DOCUMENTS

| | | |
|---|---|---|
| EP | 0 856 781 A2 | 8/1999 |
| JP | 10-142937 | 5/1998 |
| JP | 2001-255727 | 9/2001 |
| JP | 2002-72675 | 3/2002 |
| KR | 96-27617 | 8/1996 |
| KR | 10-188478 | 6/1999 |

OTHER PUBLICATIONS

Korean Official Action issued on Aug. 23, 2005, for Korean Patent Application No. 10-2003-72987 (listing 1 reference).

* cited by examiner

*Primary Examiner*—David M. Gray
*Assistant Examiner*—Ryan D. Walsh
(74) *Attorney, Agent, or Firm*—Stanzione & Kim, LLP

(57) ABSTRACT

A toner cartridge of an electrophotographic image forming apparatus. The toner cartridge of the electrophotographic image forming apparatus includes a developing roller that develops an electrostatic latent image formed on an outer circumferential surface of a photosensitive drum, a toner supplying roller that supplies toner onto the developing roller, a seal bracket that is installed above and apart from the toner supplying roller, an outer seal film including an end adhered to the seal bracket and the other end contacting an outer circumference of the developing roller, and an inner seal film that is adhered to an inner surface of the seal bracket so that an end of the inner seal film contacts an outer circumference of the supplying roller.

17 Claims, 3 Drawing Sheets

TONER CARTRIDGE USED WITH AN ELECTROPHOTOGRAPHIC IMAGE FORMING APPARATUS

CROSS-REFERENCE TO RELATED APPLICATIONS

This application claims the priority of Korean Patent Application No. 2003-72987, filed on Oct. 20, 2003, in the Korean Intellectual Property Office, the disclosure of which is incorporated herein in its entirety by reference.

BACKGROUND OF THE INVENTION

1. Field of the Invention

The present general inventive concept relates to a toner cartridge used with an electrophotographic image forming apparatus.

2. Description of the Related Art

An electrophotographic image forming apparatus such as a dry type color laser printer is an apparatus that forms an electrostatic latent image on a photosensitive medium, develops the image with a powder toner, and transfers the developed image on a document via a predetermined transfer medium to form an image. The image forming apparatus uses a photosensitive substance to develop the electrostatic latent image on the photosensitive substance, and includes a toner cartridge, which is a developing unit containing dry type toner.

Japanese Laid-open Patent No. 2001-255727 discloses an image forming apparatus including a developing device having a developing roller, and a toner cartridge supplying toner to the developing device. The toner cartridge is vertically disposed to supply the toner to a toner hopper in the developing device. Therefore, a printer including the above developing device has a large vertical volume.

In a dry type color printer having a compact structure, a toner cartridge is placed in a horizontal direction with respect to a developing unit and has a structure in which toner cartridges of different colors are vertically stacked.

FIG. 1 is a partial cross-sectional view illustrating a conventional toner cartridge supplying toner in a horizontal direction.

Referring to FIG. 1, a plurality of semicircular chambers 12 are sequentially formed at a lower portion of a housing 10, and each of the chambers 12 includes an agitator 14. A developing roller 20 is installed on a front end portion of the housing 10, and a toner supplying roller 30 is installed to contact the developing roller 20. A guide member 40 that receives the toner supplied from the agitator 14 and helps the toner attach on an outer circumference of the toner supplying roller 30 is disposed under the toner supplying roller 30. A recovery roller 50 that returns remaining toner, which is not supplied to the developing roller 20 from the toner supplying roller 30, toward the chamber 12 including the first agitator 14, is disposed under the guide member 40.

The toner supplying roller 30 rotates in the rotating direction of the developing roller 20 to clean the toner remaining on the surface of the developing roller 20 by contacting the developing roller 20, and supplies the toner onto the surface of the developing roller 20 by compressing the toner on the surface of the developing roller 20 immediately before contacting the developing roller 20.

A doctor-blade 16 is installed at the housing to remove excessive toner from the developing roller 20 in order to control the height of the toner on the surface of the developing roller 20.

The toner removed from the developing roller 20 by the doctor blade 16 and a toner passed through a toner path without being adhered to the surface of the developing roller 20 from the toner supplying roller 30 is returned to the first hopper 12 through a recovery hole 51 by the recovery roller 50.

A seal bracket 33 that covers the developing roller 20 and the supplying roller 30 and prevents the toner from being sealed outward is installed on an upper portion of the housing 10. A seal film 34 is adhered on the seal bracket 33 to prevent the toner between the developing roller 20 and the supplying roller 30 from exiting the housing 10, and to prevent external impurities from penetrating into the toner cartridge.

However, in the toner cartridge having the above structure, the toner may be stacked on the upper part of the developing roller 20 and the toner supplying roller 30 (portion A in FIG. 1). The toner stacked on the portion A interrupts the cleaning operation of the remaining toner of the developing roller 20 performed by the toner supplying roller 30. In addition, when the toner impacts the seal film 34 due to an external shock, the toner may leak through the seal film 34.

SUMMARY OF THE INVENTION

The present general inventive concept provides a toner cartridge by which accumulation of toner between a developing roller and a toner supplying roller can be prevented.

The present general inventive concept also provides a toner cartridge by which dispersion of toner that is accumulated between a developing roller and a toner supplying roller out of the toner cartridge due to an external shock can be prevented.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a toner cartridge of an electrophotographic image forming apparatus including: a developing roller that develops an electrostatic latent image formed on an outer circumferential surface of a photosensitive drum; a toner supplying roller that supplies toner onto the developing roller; a seal bracket that is installed above and apart from the toner supplying roller; an outer seal film including an end adhered to the seal bracket and the other end contacting an outer circumference of the developing roller; and an inner seal film that is adhered to an inner surface of the seal bracket so that an end of the inner seal film contacts an outer circumference of the supplying roller.

The end of the inner seal film may contact the toner supplying roller at a region where the toner supplying roller rotates downward.

The toner supplying roller and the developing roller may rotate in a direction where an exposed portion of the developing roller moves upward.

The toner supplying roller may rotate to contact the developing roller.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
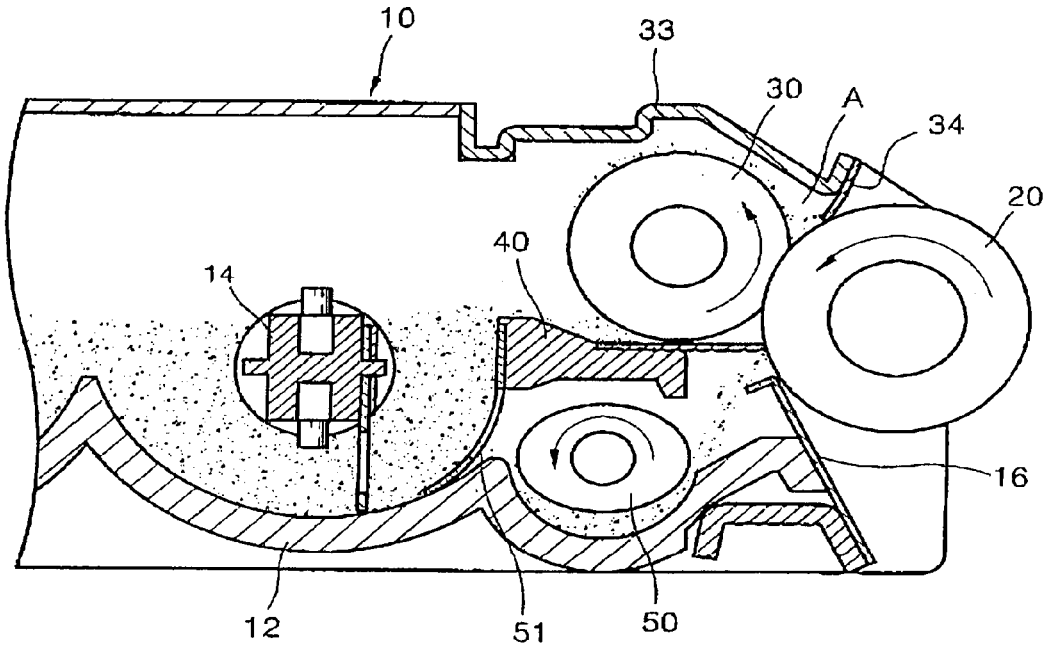
FIG. 1 (PRIOR ART)
FIG. 1 is a partial cross-sectional view illustrating a conventional toner cartridge that supplies toner in a horizontal direction.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
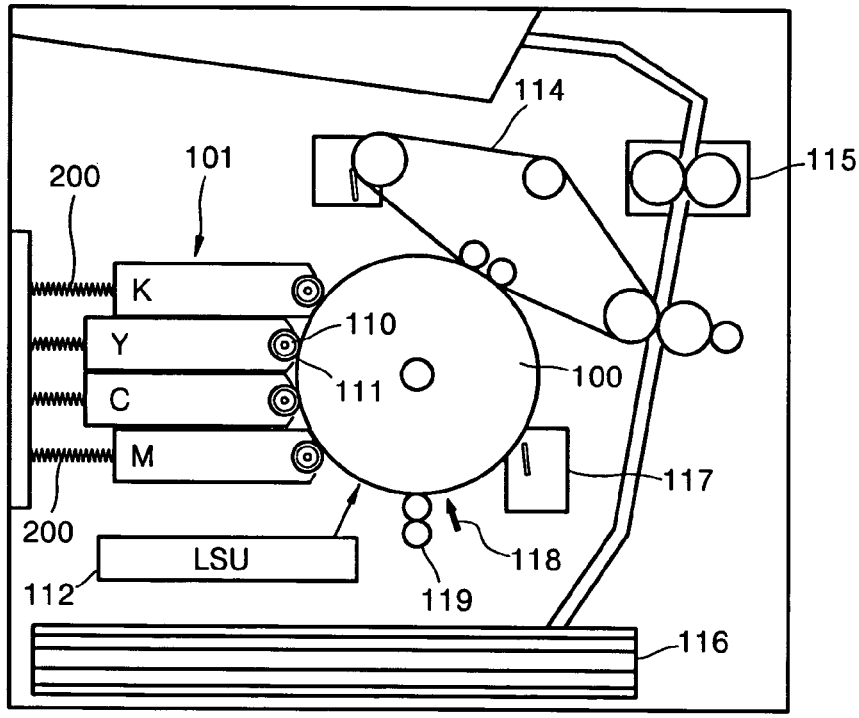
FIG. 2 is a view illustrating an electrophotographic image forming apparatus including a toner cartridge according to an embodiment of the present general inventive concept.

FIG. 2 is a view illustrating an electrophotographic image forming apparatus including toner cartridges according to an embodiment of the present general inventive concept.

Referring to FIG. 2, the image forming apparatus includes a photosensitive drum 100, a charger 119 that charges the photosensitive drum 100, a laser scanning unit 112 as an exposure unit that scans light onto the charged photosensitive drum 100 to form an electrostatic latent image, toner cartridges 101M, 101C, 101Y and 101K, which are developing devices to develop the electrostatic latent image with powder toners of four colors yellow (Y), magenta (M), cyan (C), and black (K), a transfer unit including a transfer belt 114 that receives images of four colors developed on the photosensitive drum 100 and transfers the images onto a document, and a recording unit 115 that records the images onto the document by heating and pressing the document. Reference numeral 116 denotes a document cassette, reference numeral 117 denotes a photosensitive drum cleaning unit, and 118 denotes an eraser.

Here, each of the toner cartridges of the four colors 101M, 101C, 101Y, and 101K includes a developing roller 110 that supplies toner stored in the toner cartridge to an outer circumferential surface of the photosensitive drum 100 in a state of not contacting the surface of the photosensitive drum 100, and a gap maintaining roller 111 that is installed on an axis of the developing roller 110 and adheres to the photosensitive drum 100 to maintain a constant gap between the photosensitive drum 100 and the developing roller 110. Each of the toner cartridges 101 is elastically biased toward the photosensitive drum 100 by a spring 200 so that the gap maintaining roller 111 adheres to the photosensitive drum 100.

The toner cartridges having the above structure can be stacked in a horizontal direction, and can be applied to a compact type color printer.

Figure 3:
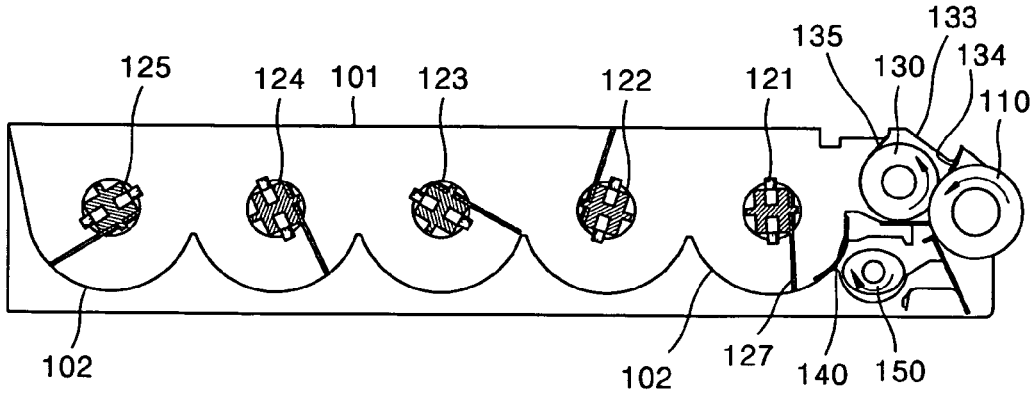
FIG. 3 is a cross-sectional view of the toner cartridge according to according to the embodiment of the present general inventive concept.
Figure 4:
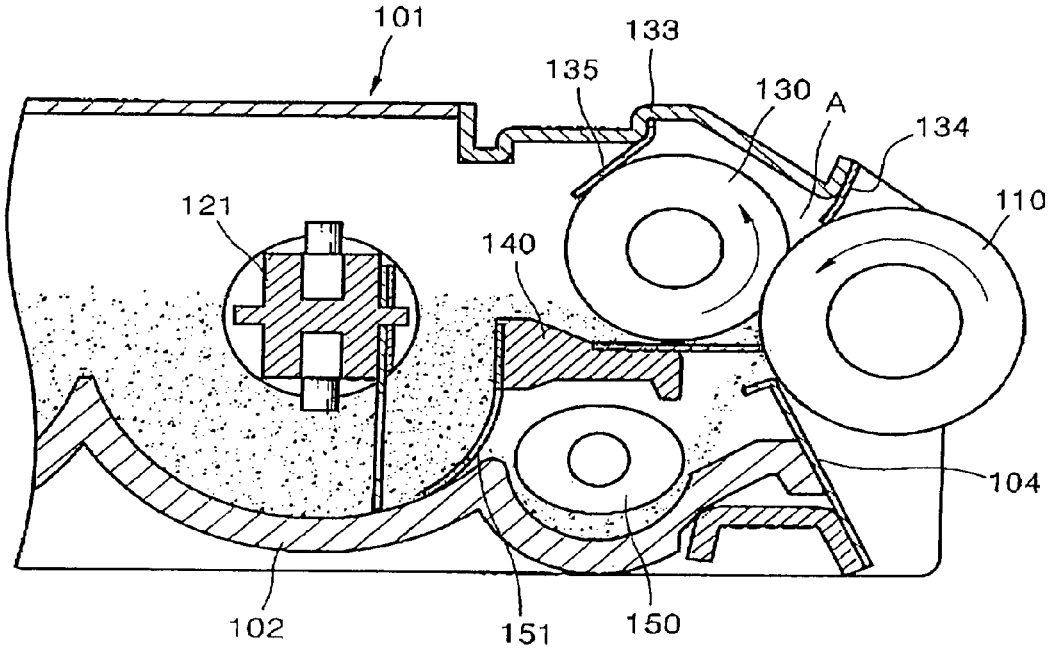
FIG. 4 is an enlarged view of a portion of the toner cartridge of FIG. 3.

FIG. 3 is a cross-sectional view illustrating the toner cartridge according to an embodiment of the present general inventive concept, and FIG. 4 is an enlarged view of a portion of FIG. 3.

Referring to FIGS. 3 and 4, five semicircular hoppers 102 are sequentially formed at a lower portion of a housing 101, and an agitator 121, 122, 123, 124, and 125 is disposed on each of the hoppers 102. The developing roller 110 is installed on a front end of the housing 101, and a toner supplying roller 130 contacts the developing roller 110. A guide 140, that receives the toner supplied from the first agitator 121 and helps the toner adhere onto an outer circumference of the toner supplying roller 130, is disposed under the toner supplying roller 130. A recovery roller 150 is disposed under the guide 140 to return the remaining toner, which is not supplied to the developing roller 110 from the toner supplying roller 130, toward the first hopper 102.

The toner supplying roller 130 rotates in a same direction as the developing roller 110, cleans the remaining toner on the surface of the developing roller 110 when it contacts the developing roller 110, and supplies the toner to the surface of the developing toner 110 by pressing the toner on the surface of the developing roller 110 immediately before contacting the developing roller 110.

A doctor blade 104 is installed at the housing 101 to control a height of the toner on the surface of the developing roller 110 that is rotating, by removing the excessive toner from the developing roller 110.

A recovery hole 151 is formed between the guide 140 and the first hopper 102. The toner removed from the developing roller 110 by the doctor blade 104 and the toner passed a toner path without being adhered onto the surface of the developing roller 110 are recovered to the first hopper 102 by the recovery roller 150 through the recovery hole 151.

A seal bracket 133 that covers the developing roller 110 and the supplying roller 130 and prevents the toner from leaking is installed on an upper portion of the housing 101. An outer seal film 134 is installed at the seal bracket 133 to contact the surface of the developing roller 110, so that the toner (portion A in FIG. 4) between the developing roller 110 and the supplying roller 130 does not leak and external impurities are not penetrated into the toner cartridge. In addition, an inner seal film 135 is installed on an inner side of the seal bracket 133.

An end of the inner seal film 135 is installed to contact the outer circumference of the supplying roller 130 to remove the toner adhered on the outer circumference of the supplying roller 130. Therefore, the toner stored in the upper portion (portion A of FIG. 4) between the developing roller 110 and the supplying roller 130 is retrieved and guided toward the first hopper 102 or the guide 140 to prevent the toner from accumulating at the portion A.

On the other hand, the inner seal film 135 prevents the toner at the first hopper 102 or the toner on the guide 140 from moving toward the portion A. Accordingly, leaking of the toner out of the outer seal film 134 due to the rapid moving of the toner at the portion A to the outer seal film 134 can be prevented.

It is desirable that the seal films 134 and 135 are fabricated using an elastic film, for example, polyethyleneterephthalate (PET) film. However, the seal films 134 and 135 can be fabricated of other type materials that accomplish the intended purpose of the present general inventive concept as described herein.

As described above, in the toner cartridge of the electrophotographic image forming apparatus of the present general inventive concept, the toner adhered onto the toner supplying roller is removed by the inner seal film 135 to prevent the toner from accumulating on the upper portions of the toner supplying roller 130 and the developing roller 110, thus improving the cleaning function of the toner supplying roller 130 and printing quality of the image forming apparatus.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A toner cartridge used with an electrophotographic image forming apparatus, comprising:

a developing member that develops an electrostatic latent image formed on an outer circumferential surface of a photosensitive drum;

a toner supplying roller that supplies toner onto the developing member;

a guide to help the toner adhere onto an outer circumference of the toner supplying roller;

a doctor blade to control a height of the toner on the developing member;

a seal bracket installed above and apart from the toner supplying roller;

an first sealing member including a first end adhering to the seal bracket and another end contacting an outer circumference of the developing member; and an second sealing member adhering to an inner surface of the seal bracket so that an end of the second sealing member contacts an outer circumference of the toner supplying roller.

2. The toner cartridge of claim 1, wherein the end of the second sealing member contacts the toner supplying roller at a region where the toner supplying roller rotates downward.

3. The toner cartridge of claim 1, wherein the toner supplying roller and the developing member rotate in a direction where an exposed portion of the developing member moves upward.

4. The toner cartridge of claim 1, wherein the toner supplying roller rotates to contact the developing member.

5. A toner cartridge comprising:

a developing member that develops an electrostatic latent image formed on an outer circumferential surface of a photosensitive drum;

a toner supplying roller that supplies toner onto the developing member;

a guide to help the toner adhere onto an outer circumference of the toner supplying roller;

a doctor blade to control a height of the toner on the developing member;

a seal bracket that is installed above and apart from the toner supplying roller;

an first sealing member including an end adhered to the seal bracket and the other end contacting an outer circumference of the developing member; and an second sealing member that is adhered to an inner surface of the seal bracket so that an end of the second sealing member contacts an outer circumference of the toner supplying roller, wherein the toner supplying roller rotates with the developing member in a direction where a portion of the toner supplying roller moves upward when in contact with the developing member.

6. A toner cartridge used with an image forming apparatus, comprising:

a developing member having a portion that extends out of the toner cartridge to develop a latent image formed on an outer circumferential surface of a photosensitive drum;

a toner supplying roller that supplies toner onto the developing member;

a guide to help the toner adhere onto an outer circumference of the toner supplying roller;

a doctor blade to control a height of the toner on the developing member;

a seal bracket installed on an upper portion of the toner cartridge to prevent toner from leaking out of the toner cartridge;

an first sealing member having a first end in contact with the seal bracket and a second end extending toward the developing member to guide remaining toner not transferred to the developing member away from the developing member and toner supplying roller and to prevent impurities from leaking into the toner cartridge; and an second sealing member having a first end in contact with an inner surface of the seal bracket and extending toward the toner supplying roller to remove remaining toner adhered to the supplying roller after the toner supplying roller transfers toner to the developing member.

7. The toner cartridge of claim 6, wherein a second end of the second sealing member contacts the toner supplying roller at a region where the toner supplying roller rotates downward.

8. The toner cartridge of claim 6, wherein the toner supplying roller and the developing member rotate in a direction where an exposed portion of the developing member moves upward and toward the toner supplying roller.

9. The toner cartridge of claim 6, wherein the toner supplying roller rotates to contact the developing member.

10. A toner cartridge used with an image forming apparatus, comprising:

a developing member having a portion that extends out of the toner cartridge to develop a latent image formed on an outer circumferential surface of a photosensitive drum;

a toner supplying roller that supplies toner onto the developing member;

a guide to help the toner adhere onto an outer circumference of the toner supplying roller;

a doctor blade to control a height of the toner on the developing member;

a seal bracket installed on an upper portion of the toner cartridge to prevent toner from leaking out of the toner cartridge;

a first seal member in contact with an inner surface of the seal bracket and extending toward the toner supplying roller to remove remaining toner adhered to the toner supplying roller after the toner supplying roller transfers toner to the developing member; and a second seal member extending from the seal bracket toward the developing member to guide remaining toner not transferred to the developing member toward the first seal member and to prevent impurities from entering into the toner cartridge at an area the developing member extends out of the toner cartridge, wherein the developing member and the toner supplying roller rotate in the same direction such that the rotation of the developing member and the toner supplying roller moves toner that collects between the seal bracket, the developing member, and the toner supplying roller upward and away from the developing member past the first seal member into the toner cartridge.

11. The toner cartridge of claim 10, wherein the first and second seal members are fabricated of an elastic film.

12. The toner cartridge of claim 11, wherein the elastic film is a polyethyleneterephthalate (PET) film.

13. A toner cartridge usable with an image forming apparatus, the toner cartridge comprising:

a developer member to develop an electrostatic image on a photosensitive drum;

a toner supplying roller to provide toner to the developer member;

a guide to help the toner adhere onto an outer circumference of the toner supplying roller;

a doctor blade to control a height of the toner on the developing member;

a housing having an upper portion disposed above the toner supply roller and the developer member;

an inner seal member attached to the upper portion of the housing and extending to the toner supplying roller; and an outer seal member attached to the upper portion of the housing and extending to the developer member, wherein the developing member and the toner supplying roller rotate in the same rotational direction such that toner that collects at the upper portion of the housing between the developing member and the toner supplying roller is moved backward away from the developing member toward the inner seal member.

14. The toner cartridge of claim 13, wherein the upper portion of the housing comprises a seal bracket to contact a surface of the developer member such that the toner between the developer member and the toner supply roller does not leak from the toner cartridge.

15. The toner cartridge of claim 13, wherein the inner seal member extends downward from the housing at a non-perpendicular angle with respect to a horizontal axis such that the inner seal member tangentially contacts an upper portion of the toner supply roller.

16. The toner cartridge of claim 13, further comprising:

a toner guide part along which toner is guided from storage to the toner supply roller, wherein the toner that is moved toward the inner seal member by the rotation of the toner supply roller and the developer member is passed between the toner supply roller and the inner seal member back to the toner guide part.

17. A toner cartridge used with an electrophotographic image forming apparatus, comprising:

a developing member that develops an electrostatic latent image formed on an outer circumferential surface of a photosensitive drum;

a toner supplying roller that supplies toner onto the developing member;

a guide to help the toner adhere onto an outer circumference of the toner supplying roller;

a doctor blade to control a height of the toner on the developing member;

a seal bracket detachably installed above and apart from the toner supplying roller;

an first sealing member including a first end to adhere to the seal bracket such that the first sealing member is removed from an elastic contact with the developing member at another end of the first sealing member when the seal bracket is detached; and an second sealing member including a first end to adhere to the seal bracket such that the second sealing member is removed from an elastic contact with the toner supplying roller at another end of the second sealing member when the seal bracket is detached.

* * * * *